US009618894B2

(12) United States Patent
Choi

(10) Patent No.: US 9,618,894 B2
(45) Date of Patent: Apr. 11, 2017

(54) IMAGE FORMING APPARATUS HAVING A COMPACT SIZE

(71) Applicant: SAMSUNG ELECTRONICS CO., LTD., Suwon-si (KR)

(72) Inventor: Dong-ha Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/564,409

(22) Filed: Dec. 9, 2014

(65) Prior Publication Data

US 2015/0093160 A1 Apr. 2, 2015

Related U.S. Application Data

(63) Continuation of application No. 11/679,473, filed on Feb. 27, 2007, now abandoned.

(30) Foreign Application Priority Data

Sep. 12, 2006 (KR) ..... 10-2006-0088284

(51) Int. Cl.

| | |
|---|---|
| ***G03G 21/00*** | (2006.01) |
| ***G03G 15/00*** | (2006.01) |
| ***G03G 21/16*** | (2006.01) |
| ***B41J 11/00*** | (2006.01) |
| ***B41J 13/10*** | (2006.01) |
| ***B41J 13/14*** | (2006.01) |
| ***B41J 29/02*** | (2006.01) |

(52) U.S. Cl.

CPC ..... *G03G 15/6561* (2013.01); *B41J 11/005* (2013.01); *B41J 13/103* (2013.01); *B41J 13/14* (2013.01); *B41J 29/023* (2013.01); *G03G 21/1609* (2013.01); *B65H 2601/523* (2013.01)

(58) Field of Classification Search

CPC ..... B41J 23/023; B54H 2601/523; G03G 21/1609; G03G 21/1628

See application file for complete search history.

(56) References Cited

U.S. PATENT DOCUMENTS

| | | | | |
|---|---|---|---|---|
| 4,126,388 | A | 11/1978 | Kawai | |
| 4,583,844 | A | 4/1986 | Honda | |
| 4,910,551 | A | 3/1990 | Onoda et al. | |
| 5,016,029 | A * | 5/1991 | Mori et al. | 347/139 |
| 5,038,228 | A | 8/1991 | Takada | |

(Continued)

FOREIGN PATENT DOCUMENTS

EP 1 132 215 A2 9/2001

OTHER PUBLICATIONS

U.S. Office Action mailed Aug. 17, 2010 in copending U.S. Appl. No. 11/679,473.

(Continued)

*Primary Examiner* — Justin Olamit

(74) *Attorney, Agent, or Firm* — Staas & Halsey LLP

(57) ABSTRACT

An image forming apparatus having a compact size includes a printing medium supplying unit to hold printing media and to supply a printing medium, an image forming unit disposed above the printing medium supplying unit to form images on a printing medium, and a printing medium feeding part substantially formed in a letter "C" shape, having a part which extends to the image forming unit and which is inclined in a downward direction along a printing medium moving direction to feed the printing medium from the printing medium supplying unit to the image forming unit.

16 Claims, 3 Drawing Sheets

(56) References Cited

U.S. PATENT DOCUMENTS

| | | | | |
|---|---|---|---|---|
| 5,347,349 | A | 9/1994 | Sato et al. | |
| 5,526,104 | A * | 6/1996 | Kawano | G03G 15/6514 271/3.01 |
| 5,528,342 | A * | 6/1996 | Setoriyama | G03G 21/1853 399/107 |
| 5,768,659 | A * | 6/1998 | Kameda | 399/111 |
| 5,790,922 | A * | 8/1998 | Takano | G03G 15/00 347/263 |
| 5,913,095 | A * | 6/1999 | Takashima | G03G 21/1628 271/213 |
| 6,311,973 | B1 | 11/2001 | Tanaka et al. | |
| 6,402,139 | B1 * | 6/2002 | Kanno | 271/240 |
| 6,953,192 | B2 * | 10/2005 | Jang | B41J 13/106 271/213 |
| 7,035,568 | B2 | 4/2006 | Sato et al. | |
| 7,619,760 | B2 | 11/2009 | Sakamoto | |
| 2005/0018215 | A1 | 1/2005 | Ruhe et al. | |
| 2005/0206667 | A1 * | 9/2005 | Ohama et al. | 347/9 |
| 2005/0226647 | A1 * | 10/2005 | Lee | G03G 15/5016 399/81 |
| 2005/0281597 | A1 | 12/2005 | Ito | |
| 2005/0281598 | A1 * | 12/2005 | Hattori | G03G 15/6573 399/405 |
| 2006/0203293 | A1 * | 9/2006 | Yasue et al. | 358/296 |

OTHER PUBLICATIONS

U.S. Final Office Action mailed Dec. 21, 2010 in copending U.S. Appl. No. 11/679,473.

U.S. Office Action mailed Apr. 8, 2011 in copending U.S. Appl. No. 11/679,473.

U.S. Final Office Action mailed Oct. 3, 2011 in copending U.S. Appl. No. 11/679,473.

U.S. Advisory Action mailed Jan. 13, 2012 in copending U.S. Appl. No. 11/679,473.

U.S. Office Action mailed Feb. 15, 2012 in copending U.S. Appl. No. 11/679,473.

U.S. Final Office Action mailed Sep. 14, 2012 in copending U.S. Appl. No. 11/679,473.

U.S. Office Action mailed Apr. 12, 2013 in copending U.S. Appl. No. 11/679,473.

U.S. Final Office Action mailed Jul. 23, 2013 in copending U.S. Appl. No. 11/679,473.

U.S. Advisory Action mailed Sep. 24, 2013 in copending U.S. Appl. No. 11/679,473.

U.S. Office Action mailed Nov. 15, 2013 in copending U.S. Appl. No. 11/679,473.

U.S. Final Office Action mailed Mar. 20, 2014 in copending U.S. Appl. No. 11/679,473.

U.S. Advisory Action mailed Jun. 3, 2014 in copending U.S. Appl. No. 11/679,473.

U.S. Office Action mailed Sep. 9, 2014 in copending U.S. Appl. No. 11/679,473.

U.S. Appl. No. 11/679,473, filed Feb. 27, 2007, Dong-ha Choi, Samsung Electronics Co., Ltd.

* cited by examiner

IMAGE FORMING APPARATUS HAVING A COMPACT SIZE

CROSS-REFERENCE TO RELATED APPLICATIONS

This application is a continuation application of U.S. patent application Ser. No. 11/679,473, filed Sep. 27, 2007, and is related to and claims the priority benefit of Korean Patent Application No. 10-2006-0088284, filed on Sep. 12, 2006, in the Korean Intellectual Property Office, the disclosure of which are incorporated herein by reference

BACKGROUND

1. Field

Aspects of the present invention relate to an image forming apparatus. More particularly, aspects of the present invention relate to an arrangement of parts of an image forming apparatus which causes the image forming apparatus to have a compact size.

2. Description of the Related Art

Generally, image forming apparatuses, (especially electro photographic image forming apparatuses such as laser printers), include a printing medium supplying unit that holds printing media (such as sheets of paper), picks up the printing media one by one, and supplies the picked up printing medium; a feeding roller that supplies the printing medium picked up from the printing medium supplying unit; an image forming unit that forms images corresponding to printing data on the printing medium fed by the feeding roller, a fixing unit that fixes the images formed onto the printing medium by the image forming unit; and a discharging unit that discharges the printing medium as the printing medium passes through the fixing unit to the outside thereof.

The conventional image forming apparatuses including above-described parts may be classified into two types which have different basic structures according to an arrangement of parts thereof: an "S" type and a "C" type. The "S" type is an image forming apparatus that has a printing medium moving path which is similar to the shape of the letter "S." The "C" type is an image forming apparatus that has a printing medium moving path which is similar to the shape of the letter "C".

FIG. 1 shows an "S" type conventional image forming apparatus 10. Referring to FIG. 1, a printing medium supplying unit 11 is disposed at a low vertical position of the image forming apparatus 10. A feeding roller 13, an image forming unit 15, and a fixing unit 17 are disposed in a row above the printing medium supplying unit 11. According to this structure, the feeding roller 13, the image forming unit 15, and the fixing unit 17 are disposed in such a way that the positions at which a printing medium passes through each of the feeding roller 13, the image forming unit 15, and the fixing unit 17 are at approximately the same horizontal level. Alternatively, the feeding roller 13, the image forming unit 15, and the fixing unit 17 are disposed in such a way that the positions at which a printing medium passes through are slightly upwardly inclined from the feeding roller 13 to the fixing unit 17.

The exposure unit 16 irradiates laser beams corresponding to printing data onto a photosensitive medium 15*a* of the image forming unit 15. The exposure unit 16 is disposed above the image forming unit 15. A feed guiding part 12 is disposed between the printing medium supplying unit 11 and the feeding roller 13 to divert a printing medium from its feeding direction, so that the printing medium picked up at the printing medium supplying unit 11 is fed to the feeding roller 13. An auxiliary printing medium supplying unit 14 is disposed at a side of the feeding roller 13 to feed special kinds of printing medium, such as envelopes, into the image forming apparatus 10.

A discharging unit 18 is disposed above the fixing unit 17. Printing media discharged from the discharging unit 18 are piled up at a printing medium storing part 19 disposed above the exposure unit 16. Also, a discharge guiding part 18*a* is disposed between the discharging unit 18 and the fixing unit 17 to divert a printing medium from its feeding direction, so that the printing medium which passes through the fixing unit 17 is fed to the discharging unit 18.

Therefore, the printing medium supplying unit 11 picks up printing media one by one, and the feed guiding part 12 diverts each of the printing media from its feeding direction to feed the printing media to the feeding roller 13. The feeding roller 13 feeds the printing medium to the image forming unit 15. At this time, the exposure unit 16 forms electrostatic latent images corresponding to printing data on the photosensitive medium 15*a* of the image forming unit 15, and the image forming unit 15 develops the electrostatic latent images into images using toner.

The images formed on the photosensitive medium 15*a* of the image forming unit 15 are transferred onto a printing medium as the feeding roller 13 moves the printing medium between the photosensitive medium 15*a* and the transferring roller 15*b*. When the printing medium with the transferred images passes through the fixing unit 17, the images are fixed onto the printing medium. Then, the printing medium with the fixed images moves along the discharge guiding part 18*a* to the discharging unit 18. The printing medium is discharged onto the printing medium storing part 19 disposed above the exposure unit 16 and the image forming unit 15, and the printing work is completed.

However, because a printing medium has to change a feeding direction twice during the printing work, it is difficult to design an "S" type image forming apparatus 10 which has a structure having a lower height and a shorter length. Also, it is difficult to design an "S" type image forming apparatus 10 which has a compact size because there are some dead spaces that cannot be used, such as a first space 21 between the feeding roller 13 and the printing medium storing part 19, and a second space 22 between the exposure unit 16 and the fixing unit 17, as illustrated in FIG. 1.

Referring to FIG. 2, a "C" type conventional image forming apparatus 30 includes a printing medium supplying unit 31 disposed at a low position therein. A feeding roller 33, an image forming unit 35, and a fixing unit 37 are vertically disposed in a row above the printing medium supplying unit 31. An auxiliary printing medium supplying unit (not shown) may be disposed above the printing medium supplying unit 31 to feed special kinds of printing media, such as envelopes, into the image forming apparatus 30. A discharging unit 38 is disposed above the fixing unit 37, and discharges printing media to a printing medium storing part 39 disposed above the image forming unit 35. An exposure unit 36 is disposed at a side of the image forming unit 35 to form electrostatic latent images on a photosensitive medium 35*a*.

Therefore, the printing medium supplying unit 31 picks up printing media loaded therein one by one and feeds the sheets of printing media to the feeding roller 33. The feeding roller 33 feeds each of the printing media to the image forming unit 35. At this time, the exposure unit 36 forms electrostatic latent images corresponding to printing data on the photosensitive medium 35*a* of the image forming unit 35, and the image forming unit 35 develops the electrostatic latent images into images using toner. The transferring roller 35*b* transfers the images formed on the photosensitive medium 35*a* of the image forming unit 35 onto a printing medium passing between the photosensitive medium 35*a* and the transferring roller 35*b*. While the printing medium with the transferred images passes through the fixing unit 37, the images are fixed onto the printing medium. The discharging unit 38 discharges the printing medium with the fixed images to the printing medium storing part 39, and the printing work is completed.

Because a printing medium has to change its feeding direction only once during the printing work, the "C" type image forming apparatus 30 may be designed to have a shorter length than the length of the "S" type image forming apparatus 10. However, because the printing medium supplying unit 31, the image forming unit 35, the fixing unit 37, and the discharging unit 38 are vertically disposed in a line, the "C" type image forming apparatus 30 has a higher height. Also, it is difficult to design a "C" type image forming apparatus 30 which has a compact size because there are some dead spaces that cannot be used, such as a third space 41 between the printing medium supplying unit 31 and the exposure unit 36, and a fourth space 42 between the exposure unit 36 and the printing medium storing unit 39, as illustrated in FIG. 2.

Furthermore, in each of the conventional "S" type and "C" type image forming apparatuses 10 and 30, printing media are discharged to the printing medium storing parts 19 and 39 formed at top surfaces of the image forming apparatuses 10 and 30, respectively, so that the image forming apparatuses 10 and 30 should have printing medium supporting plates 19*a* and 39*a*, respectively, to prevent the discharged printing medium from falling to the floor. The use of these printing medium supporting plates 19*a* and 39*a* increases the number of parts of the image forming apparatuses 10 and 30.

Also, because a printing medium is discharged through a top surface of the image forming apparatuses 10 and 30, users cannot use a space above the top surface of the image forming apparatus 10 and 30, which is also a problem.

SUMMARY

Aspects of the present invention have been developed in order to overcome the above and/or other drawbacks and/or other problems associated with the conventional arrangement of image forming apparatuses. An aspect of the present invention provides an image forming apparatus having a more compact size than the conventional image forming apparatus.

Also, another aspect of the present invention provides an image forming apparatus that discharges a printing medium through a side thereof so that a space above a top surface thereof can be used.

Additional aspects and/or advantages of the invention will be set forth in part in the description which follows and, in part, will be obvious from the description, or may be learned by practice of the invention.

The above aspects and/or other features of the present invention can substantially be achieved with an image forming apparatus which includes a printing medium supplying unit to hold and supply printing media, an image forming unit disposed above the printing medium supplying unit to form images on one of the printing media supplied from the printing medium supplying unit, and a printing medium feeding part substantially formed in a letter "C" shape, having a part which extends to the image forming unit and which is inclined in a downward direction along a printing medium moving direction to feed the printing medium from the printing medium supplying unit to the image forming unit in the downward direction towards the printing medium supplying unit.

The image forming apparatus according to an aspect further includes a case holding the printing medium supplying unit, the image forming unit, and the printing medium feeding part, and an auxiliary printing medium supplying unit disposed between a top surface of the case and a top end of the printing medium feeding part to supply another printing medium to the image forming unit.

The image forming apparatus according to an aspect may further include a discharging unit disposed above the printing medium supplying unit to discharge the one printing medium through a side of the case.

Also, the image forming apparatus according to an aspect may further include a printing medium supporting part disposed between the discharging unit and the side of the case to support the printing medium and the second printing medium discharged from the discharging unit. The printing medium supporting part may be inclined downward along a printing medium discharging direction so as to support the one printing medium on an incline.

According to another aspect of the present invention, an image forming apparatus includes a case, a printing medium supplying unit disposed at a lower portion of the case to hold and supply printing media, an image forming unit disposed above the printing medium supplying unit within the case to form images on one of the printing media, a printing medium feeding part within the case having a feeding roller to feed the printing medium from the printing medium supplying unit to the image forming unit and a printing medium feeding path that connects the feeding roller with the image forming unit and which is inclined in a downward direction to feed the one printing medium down to the image forming unit, a fixing unit within the case to fix images formed by the image forming unit onto the printing medium, a discharging unit to discharge the printing medium with the fixed images outside of the case, and a controller to control the printing medium supplying unit, the image forming unit, the feeding roller, the fixing unit, and the discharging unit in order to perform printing operations.

The image forming apparatus according to another aspect may further include an auxiliary printing medium supplying unit disposed between a top surface of the case and the feeding roller to supply another printing medium to the image forming unit.

According to another aspect, the auxiliary printing medium supplying unit may include a printing medium entrance formed at a back area of the top surface of the case and a door to selectively open or close the printing medium entrance.

According to another aspect, the image forming unit may be disposed so that a height from a bottom surface of the case to a part of the image forming unit at which images are transferred onto the one printing medium is lower than a height from the bottom surface of the case to a top end of the feeding roller.

According to another aspect, a top surface of the case is formed in a plane substantially parallel to a bottom surface of the case, and the height from the bottom surface of the case to the top surface of the case is approximately 150 mm or less.

According to another aspect, the discharging unit is disposed above the printing medium supplying unit at a side of the fixing unit to discharge the printing medium through the side of the case.

According to another aspect, the image forming apparatus may further include a printing medium supporting part formed between the discharging unit and the side of the case to support the one printing medium discharged from the discharging unit.

According to another aspect, the printing medium supporting part may be inclined in a downward direction along a printing medium discharging direction so as to support the one printing medium on an incline.

According to another aspect, the fixing unit may be disposed so that a height from a bottom surface of the case to a part of the fixing unit at which a printing medium passes through is substantially the same height as a height from the bottom surface of the case to a part of the image forming unit at which images are transferred onto the printing medium.

According to another aspect, the discharging unit may be disposed so that a height from a bottom surface of the case to a part of the discharging unit through which a printing medium passes is higher than a height from the bottom surface of the case to a part of the fixing unit through which the printing medium passes.

The controller according to an aspect of the invention may be disposed above the discharging unit near a side of the case through which the printing medium is discharged.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
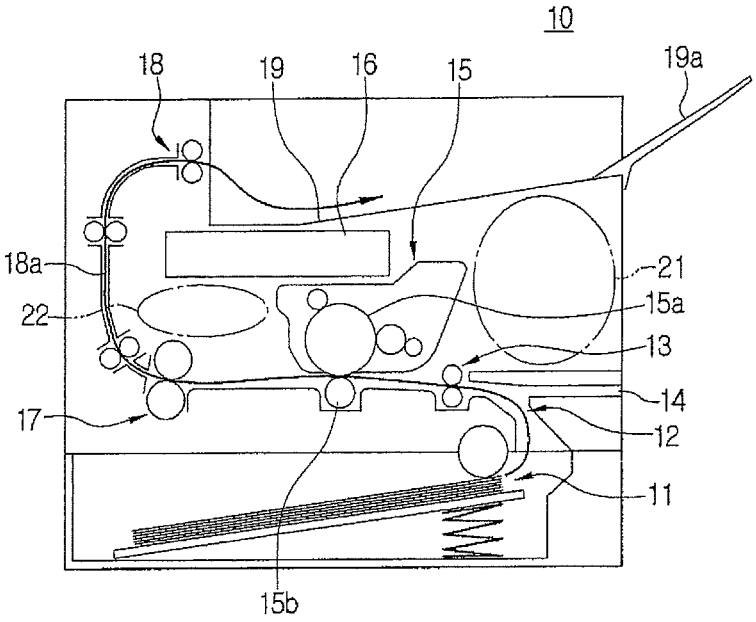
FIG. 1 (PRIOR ART)
FIG. 1 is a sectional view schematically illustrating a conventional "S" type image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
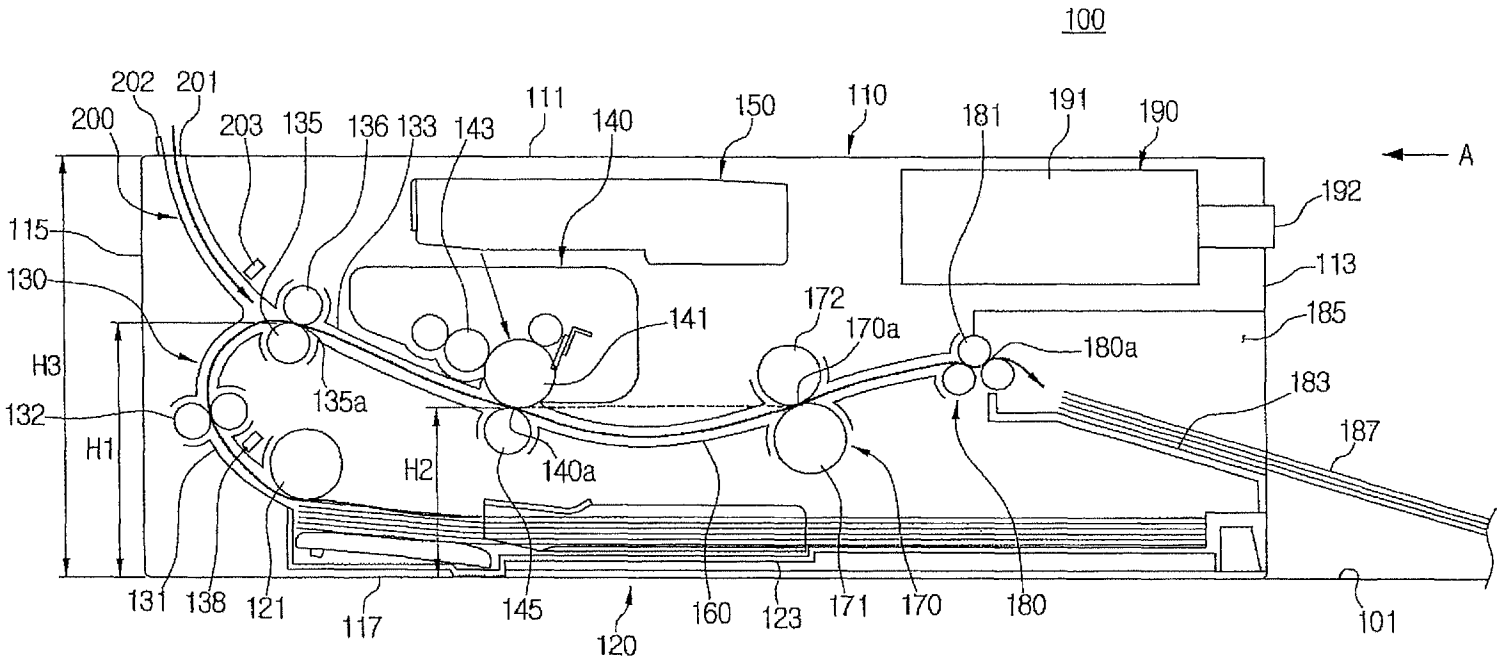
FIG. 3 is a sectional view schematically illustrating an image forming apparatus according to an embodiment of the present invention.

Referring to FIG. 3, an image forming apparatus 100 according to an embodiment of the present invention includes a case 110, a printing medium supplying unit 120, a printing medium feeding part 130, an image forming unit 140, a fixing unit 170, a discharging unit 180, and a controller 190. It is understood that other components may be used instead of or in addition to the components shown in FIG. 3 and described above.

The case 110 forms the outside of the image forming apparatus 100, and encases a printing medium supplying unit 120, an image forming unit 140, a printing medium feeding part 130, a fixing unit 170, a discharging unit 180, and a controller 190, for support and protection. The case 110 has a top surface 111 formed in a plane substantially parallel to a bottom surface 117. It is understood the top surface 111 is not required to be formed substantially parallel to the bottom surface 117, and may instead be curved or designed in numerous other ways. The top surface 111 may also be formed to have indentations for holding various items, such as, for example, sheets of paper.

The printing medium supplying unit 120 is disposed at a lower portion of the case 110. The printing medium supplying unit 120 holds predetermined sheets of printing media (such as paper, transparency sheets, etc.), and picks up each sheet one by one to feed the sheet to the printing medium feeding part 130. The printing medium supplying unit 120 includes a printing medium cassette 123 to hold printing media and a pickup roller 121 disposed above the printing medium cassette 123 to pick the sheets up from the printing medium cassette 123.

The image forming unit 140 is disposed above the printing medium supplying unit 120, and forms images on a printing medium. The image forming unit 140 includes a photosensitive medium 141 on which an exposure unit 150 irradiates laser beams to form electrostatic latent images, a developing roller 143 to develop the electrostatic latent images on the photosensitive medium 141 using toner, and a transferring roller 145 disposed to be in contact with the photosensitive medium 141. When a printing medium fed from the printing medium supplying unit 120 passes between the photosensitive medium 141 and the transferring roller 145, images formed on the photosensitive medium 141 are transferred onto the printing medium.

The printing medium feeding part 130 is disposed between the printing medium supplying unit 120 and the image forming unit 140, and feeds a printing medium picked up by the pickup roller 121 of the printing medium supplying unit 120 to the image forming unit 140. The printing medium feeding part 130 is formed substantially in the shape of the letter "C". A part of the printing medium feeding part 130 which extends to the image forming unit 140 is inclined in a downward direction along a printing medium moving direction. The shown printing medium feeding part 130 includes a printing medium reversing path 131 and a printing medium feeding path 133 that extends from a front end of the printing medium reversing path 131 and is inclined in a downward direction along the printing medium moving direction. However, it is understood that the printing medium feeding part 130 need not include the printing medium reversing path 131 and/or the printing medium feeding path 133 in all aspects of the invention.

A pair of transporting rollers 132 is preferably, but not necessarily, disposed at approximately the middle of the printing medium reversing path 131 to transport a printing medium picked up by the pickup roller 121. It is understood that one or more than two transporting rollers may be used instead of the pair of transporting rollers 132, and that these transporting rollers may be disposed in various positions other than the position shown in FIG. 3. A printing medium detecting sensor 138 is disposed between the pickup roller 121 and a pair of transporting rollers 132 to detect a printing medium. A feeding roller 135 is disposed at the location where the printing medium reversing path 131 is connected to the printing medium feeding path 133, and feeds a printing medium to the image forming unit 140.

Figure 2:
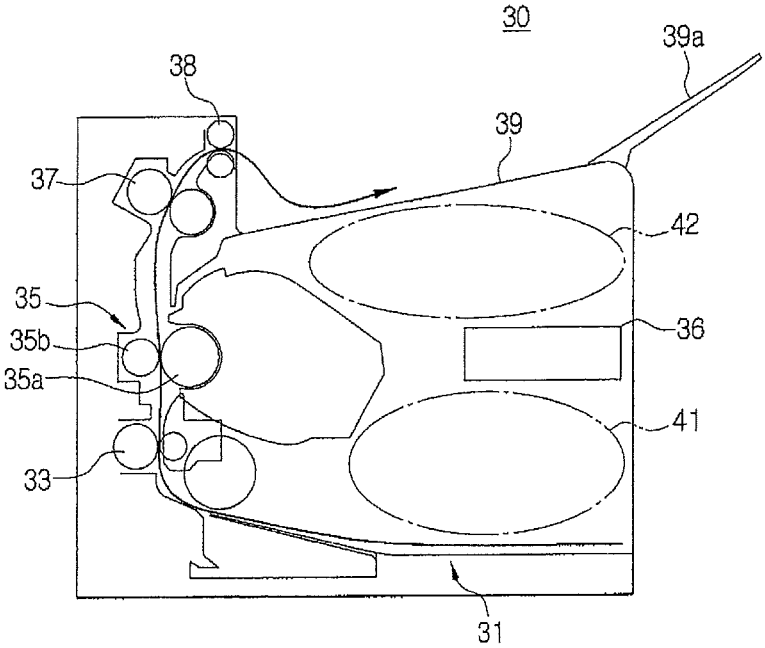
FIG. 2 (PRIOR ART)
FIG. 2 is a sectional view schematically illustrating a conventional "C" type image forming apparatus.

The printing medium feeding path 133, through which a printing medium moves from the feeding roller 135 to the photosensitive medium 141 of the image forming unit 140, is inclined in a downward direction relative to the printing medium moving direction, so that a mounting height of the image forming unit 140 is lower than the mounting height of the exposure units 16 and 36 shown in FIGS. 1 and 2, respectively. In other words, since the printing medium feeding path 133 is formed to incline in a downward direction relative to the printing medium moving direction, the image forming unit 140 is disposed inside the case 110 in such a way that a height of a part 140*a* of the image forming unit 140 where images are transferred onto a printing medium is lower than a height of a top end of the feeding roller 135.

The part 140*a* of the image forming unit 140 where images are transferred onto a printing medium is a contacting part disposed between the photosensitive medium 141 and the transferring roller 145. Therefore, the contacting part 140*a* is located at a lower position than a contacting part 135*a* disposed between the feeding roller 135 and a feeding backup roller 136. By lowering the mounting height of the image forming unit 140, the height H3 of the image forming apparatus 100 is lowered.

In an image forming apparatus 100 according to an embodiment of the present invention, when the height H1 from the bottom surface 117 to the contacting part 135*a* disposed between the feeding roller 135 and the feeding backup roller 136 is set to be approximately 90 mm, the height H2 from the bottom surface 117 to the contacting part 140*a* between the photosensitive medium 141 and the transferring roller 145 is preferably set to be approximately 60 mm. However, it is understood that the heights H1 and H2 are not required to be adjusted to 90 mm and 60 mm, respectively, and are not required to be set to a 3:2 ratio, respectively.

Conventionally, in order to lower a height H3 of an image forming apparatus 100, designers have tried to lower a height of the printing medium feeding part 130 which feeds a printing medium from the printing medium supplying unit 120 to the image forming unit 140. In other words, designers have tried to decrease a curvature radius of the printing medium reversing path 131 of the printing medium feeding part 130 formed in a curved line like a letter "C", thereby lowering the height H3 of the image forming apparatus 100. However, when a curvature radius of the printing medium reversing path 131 is decreased too much, various problems occur. For example, a printing medium gets easily jammed, feeding a printing medium generates a loud noise, and a printing medium gets damaged during feeding. To prevent these problems from occurring, the printing medium reversing path 131 must have a curvature radius larger than a predetermined curvature radius. As a result, using the conventional method to lower a height of an image forming apparatus produces very limited results.

However, as described above, in an image forming apparatus 100 according to an embodiment, a curvature radius of the printing medium reversing path 131, and more specifically, a height of the printing medium reversing path 131, is substantially the same as the height of the printing medium reversing path 131 used in the conventional image forming apparatus 10 or 30. Additionally, the printing medium feeding path 133, which is connected to the printing medium reversing path 131 through which a printing medium moves to the image forming unit 140 after being reversed, is inclined in a downward direction along a printing medium moving direction. As a result, the image forming apparatus 100 according to an embodiment can prevent above-described problems from occurring, and can lower the height H3 of the image forming apparatus 100.

The exposure unit 150 is disposed above the image forming unit 140 to irradiate laser beams corresponding to printing data so as to form electrostatic latent images on the photosensitive medium 141. The printing medium supplying unit 120, the image forming unit 140, and the exposure unit 150 are vertically arranged above the bottom surface 117 of the case 110. When a height H1 from the bottom surface 117 to the contacting part 135*a* of the feeding roller 135 is approximately 90 mm, a height H3 from the bottom surface 117 to the top surface 111 of the case 110 is approximately 150 mm or less. However, it is understood that H1 and H3 are not limited to being 90 mm and 150 mm, respectively, and are not required to be set to a 3:5 ratio, respectively.

The fixing unit 170 is disposed at a side of the image forming unit 140 above the printing medium supplying unit 120. The fixing unit 170 fixes images, which are transferred onto a printing medium when the printing medium passes through the image forming unit 140, using high temperature and high pressure. The fixing unit 170 includes a pressure roller 172 to press a printing medium and a heating roller 171 to generate a high temperature.

According to an aspect of the invention, the fixing unit 170 is preferably disposed in the case 110 in such a way that a height of a contacting part 170*a* disposed between the pressure roller 172 and the heating roller 171 where a printing medium passes through the fixing unit 170 is substantially the same as the height of the contacting part 140*a* disposed between the photosensitive medium 141 and the transferring roller 145 of the image forming unit 140. A fixing feeding path 160 through which a printing medium moves from the image forming unit 140 to the fixing unit 170 is shown formed in a concave shape, as illustrated in FIG. 3. Therefore, a printing medium moves in a downward direction from the feeding roller 135 to the image forming unit 140, and then moves in an upward direction while passing along the fixing feeding path 160. It is understood that the contacting parts 170*a* and 140*a* are not required to be disposed at substantially the same height. It is further understood that the fixing feeding path 160 is not necessarily required to be concave, and may instead take other shapes, such as, for example, a flat horizontal shape.

The discharging unit 180 is disposed at a side of the fixing unit 170 above the printing medium supplying unit 120, and discharges a printing medium with fixed images passing through the fixing unit 170 to the outside of the image forming apparatus 100 through a side 113 of the case 110. Hereinafter, a side 113 (namely, a right side in FIG. 3) of the case 110 through which a printing medium is discharged is referred to as a front surface of the case 110, and an opposite side 115 (namely, a left side in FIG. 3) of the case 110 is referred as a back surface of the case 110.

The shown discharging unit 180 is configured to include a plurality of discharging rollers 181. The discharging unit 180 is shown disposed in such a way that a part 180*a* of the discharging unit 180 through which a printing medium passes is located at substantially the same height as the part 170*a* of the fixing unit 170 through which a printing medium passes through. The discharging unit 180 is disposed in such a way that a height of the part 180*a* of the discharging unit 180 through which a printing medium passes is higher than the height of the part 170*a* of the fixing unit 170. The reason why it is preferable to mount the part 180*a* at a higher height than the part 170*a* is because mounting the discharging unit 180 at a higher level allows a large amount of discharged printing media to be piled up. However, it is understood that the part 180*a* may also be mounted at a lower height than the part 170*a*, in which case a lower level of discharged printing media can be piled up.

The discharging unit 180 is shown disposed near the front surface 113 of the case 110 so that printing media are directly discharged to the outside of the case 110. Preferably, the discharging unit 180 is disposed at a predetermined distance from the front surface 113 inside of the case 110, and a printing medium supporting part 183 is disposed between the discharging unit 180 and the front surface 113 of the case 110 to receive printing media 187 discharged by the discharging unit 180. A discharging space 185 where a predetermined sheet of printing media discharged from the discharging unit 180 can be piled up is formed above the printing medium supporting part 183. The discharging space 185 is preferably formed as a recess, such as a concave shape, in the front surface 113 of the case 110. The discharging space 185 allows some of the space above the printing medium supplying unit 120 to be used for receiving discharged printing media, thus providing a compact image forming apparatus 100.

The printing medium supporting part 183 is shown formed integrally with the case 110, as illustrated in FIG. 3. Alternatively, although not illustrated, the printing medium supporting part 183 may be formed as a separate part which attaches and detaches to and from the front side 113 of the case 110. The printing medium supporting part 183 may be used when a resting surface 101, such as a top surface of a desk where the image forming apparatus 100 is set up, does not have enough space to receive printing media 187 discharged from the image forming apparatus 100.

The printing medium supporting part 183 may be disposed to be inclined in an upward or downward direction with respect to the printing medium discharging direction, or may be disposed parallel to the resting surface 101. As illustrated in FIG. 3, when the printing medium supporting part 183 is inclined in a downward direction with respect to the printing medium discharging direction, a printing medium discharged by the discharging unit 180 moves in a stable fashion along the printing medium supporting part 183, and is thus piled up in a stable fashion on the resting surface 101, such as a desk, where the image forming apparatus 100 is set up. In other words, a space on the resting surface 101, such as a top surface of a desk, where the image forming apparatus 100 is set up can be used as a space for piling up discharged printing media.

The controller 190 controls the printing medium supplying unit 120, the image forming unit 140, the feeding roller 135, the fixing unit 170, and the discharging unit 180 to control printing operations. The controller 190 is shown disposed above the discharging unit 180 and the printing medium supporting part 183. The controller 190 includes a circuit board 191 for controlling printing operations, an operation display part 193 (see FIG. 4) for displaying a printing status, a power switch 192 for turning on and off power supplied to the image forming apparatus 100, and control buttons 195 (see FIG. 4) for users to control the image forming apparatus 100. However, it is understood that the controller 190 can be otherwise located.

In the shown embodiment, the circuit board 191 is disposed above the discharging unit 180 and the discharging space 185 to maximize the use of an inner space of the case 110. Since the circuit board 191 is disposed near the front surface 113 of the case 110 according to the arrangement of an embodiment, the circuit board 191 is located close to the operation display part 193, the power switch 192, and the control buttons 195, which are each shown disposed on the front surface 113 of the case 110. Therefore, it is not required to fix each of the operation display part 193, the power switch 192, and the control buttons 195 to the case 110, and then to connect each of these components to the circuit board 191 using electrical wires. In other words, the operation display part 193, the power switch 192, and the control buttons 195 may all be directly disposed on the circuit board 191.

As a result, fixing the circuit board 191 to the case 110 will also fix the operation display part 193, the power switch 192, and the control buttons 195 on the case 110. Therefore, the image forming apparatus 100 according to an embodiment does not require separate parts to fix each of the operation display part 193, the power switch 192, and the control buttons 195 to the case 110, decreasing the cost of materials and assembly. It is understood, however, that the operation display part 193, the power switch 192, and the control buttons 195 are not required to be fixed to the circuit board 191, and that these components may each be installed separately to the case 110, or some components may be fixed to the circuit board 191 and other components may be separately installed to the case 110.

Figure 4:
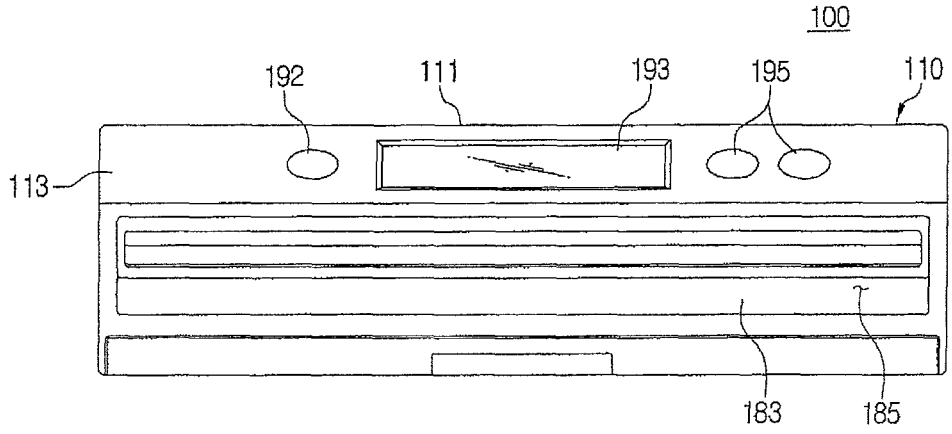
FIG. 4 is a side view illustrating the image forming apparatus 100 of FIG. 3 in a direction indicated by arrow A.
Figure 5:
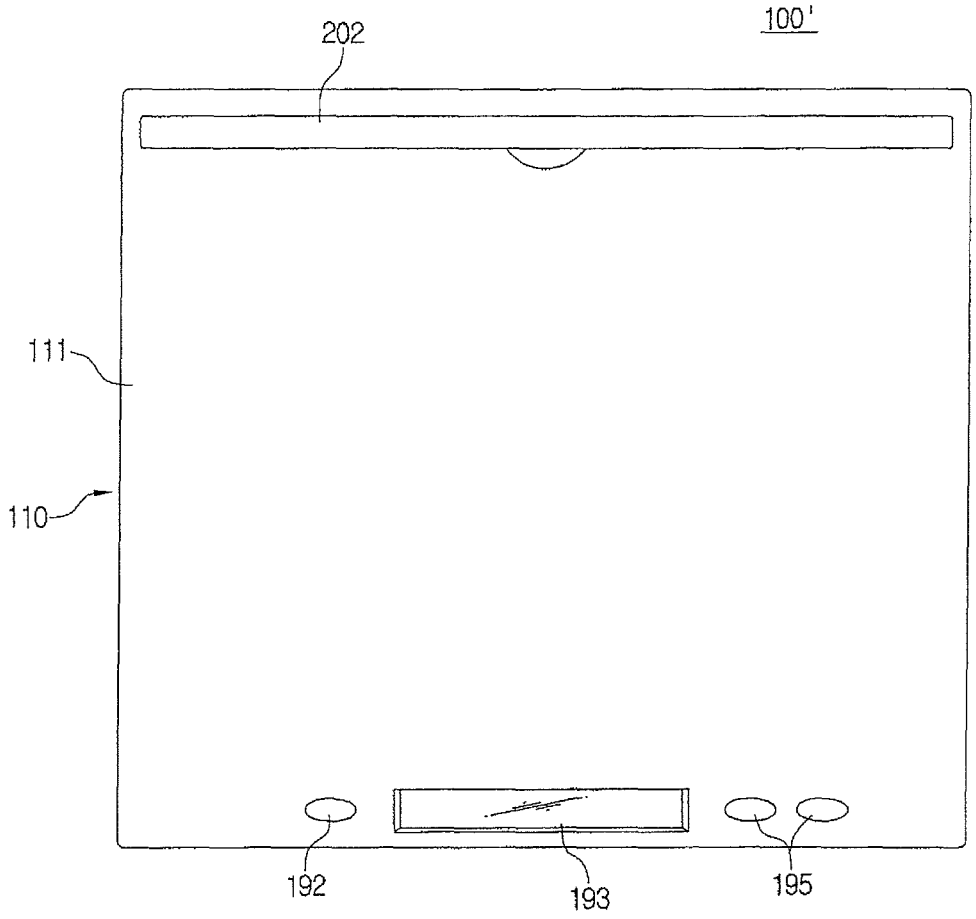
FIG. 5 is a plan view illustrating an image forming apparatus 100' according to another embodiment of the present invention

The operation display part 193, the power switch 192, and the control buttons 195 are preferably arranged at the front surface 113 of the case 110, as illustrated in FIG. 4. Alternatively, the operation display part 193, the power switch 192, and the control buttons 195 may be arranged at a front area of the top surface 111 of the case 110, as illustrated in FIG. 5. It is understood that the controller 190 may be connected to an electronic device, such as a computer or a digital camera, via a network or wirelessly.

An image forming apparatus 100 according to an embodiment of the present invention may further include an auxiliary printing medium supplying unit 200 for supplying special kinds of printing media, such as an envelope, a thick printing medium, etc., into the image forming apparatus 100. It is understood that regular printing media may also be supplied into the image forming apparatus 100 by the auxiliary printing medium supplying unit 200. The auxiliary printing medium supplying unit 200 is preferably disposed between the top surface 111 of the case 110 and a top end of the printing medium feeding part 130, although may be disposed in other locations as well, such as off to a side of the case 110.

According to an embodiment, the feeding roller 135 is disposed at the top end of the printing medium feeding part 130 so that the auxiliary printing medium supplying unit 200 is disposed between the top surface 111 of the case 110 and the feeding roller 135. A printing medium entrance 201 of the auxiliary printing medium supplying unit 200 is formed at a back area of the top surface 111 of the case 110. Since the printing medium entrance 201 according to an embodiment is formed at the top surface 111 of the case 110, users can supply printing media, including special kinds of printing media, in a downward direction. Therefore, it is easy to supply printing media into the image forming apparatus 100 using the auxiliary printing medium supplying unit 200.

The auxiliary printing medium supplying unit 200 may further include an auxiliary printing medium detecting sensor 203. When the auxiliary printing medium detecting sensor 203 detects a printing medium, the controller 190 rotates the feeding roller 135 to feed the printing medium entering the auxiliary printing medium supplying unit 200 to the image forming unit 140.

Furthermore, the auxiliary printing medium supplying unit 200 may include a door 202 to selectively open or close the printing medium entrance 201. To supply a printing medium into the auxiliary printing medium supplying unit 200, users open the door 202 to supply a printing medium through the printing medium entrance 201. When the auxiliary printing medium supplying unit 200 is not in use, users can close the door 202 to prevent foreign materials, such as dust, from entering the case 110 through the printing medium entrance 201. The door 202 may be fixed by a hinge so that users can easily open or close the door 202 by hand, although the door 202 may also be controlled automatically, for example, by the controller 190. It is understood that the door 202 may be fixed to the case 110 with various types of fasteners other than a hinge.

Hereinafter, an operation of an image forming apparatus 100 according to an embodiment of the present invention will be described with reference to FIGS. 3 and 4. Upon receiving a printing order from a host (not shown), such as a computer connected to the image forming apparatus 100, the controller 190 operates the pickup roller 121 to pick up a printing medium loaded into the printing medium supplying unit 120 and to feed the printing medium to the feeding roller 135. When the printing medium detecting sensor 138 is triggered by the picked up printing medium, the controller 190 operates the transporting roller 132 and the feeding roller 135 to feed the printing medium to the image forming unit 140.

The controller 190 controls the exposure unit 150 to irradiate laser beams corresponding to printing data onto the photosensitive medium 141 of the image forming unit 140. The electrostatic latent images corresponding to printing data received from the host are formed on the photosensitive medium 141.

When the photosensitive medium 141 rotates, toner supplied by the developing roller 143 develops the electrostatic latent images into toner images. The toner images on the photosensitive medium 141 are transferred onto a printing medium which is fed by the feeding roller 135 to pass between the photosensitive medium 141 and the transferring roller 145.

The printing medium having the transferred images continues to move to the fixing unit 170. When the printing medium moves to the fixing unit 170, it passes between the pressure roller 172 and the heating roller 171. At this time, the transferred images are fixed on the printing medium by the high pressure generated by the pressure roller 172 and the high temperature generated by the heating roller 171.

The printing medium having the fixed images is discharged through the front surface 113 of the image forming apparatus 100 by the discharging unit 180. The discharged printing medium moves in a stable fashion along the printing medium supporting part 183 disposed in front of the discharging unit 180. Finally, the printing medium 187 piles up on the printing medium supporting part 183 of the image forming apparatus 100 and the resting surface 101, as illustrated in FIG. 3.

In an image forming apparatus 100 according to an embodiment of the present invention, since the printing medium reversing path 131 is substantially formed in the shape of the letter "C" and the printing medium feeding path 133 expended from the feeding roller 135 is configured to be inclined in a downward direction in relation to the print medium moving direction, the image forming unit 140 and the fixing unit 170 are located lower than the feeding roller 135. Arranging the printing medium feeding part 130, the image forming unit 140, and the fixing unit 170 according to aspects described above minimizes unused spaces inside the image forming apparatus 100, such as, for example, the first, second, third, and fourth spaces 21, 22, 41 and 42 inside the conventional image forming apparatus 10 and 30 as illustrated in FIGS. 1 and 2.

By minimizing these unused spaces 21, 22, 41, and 42, the image forming apparatus 100 according to an embodiment has a height much lower than the height of the conventional image forming apparatus 10 and 30. Therefore, an image forming apparatus 100 according to aspects of the present invention has a more compact and slim size than the sizes of the conventional image forming apparatuses 10 and 30.

Furthermore, since the image forming apparatus 100 according to aspects of the present invention discharges a printing medium through the front surface 113 of the case 110, the top surface 111 of the case 110 may be formed in a plane substantially parallel to the bottom surface 117 thereof. Therefore, users can use a space above the top surface 111 of the case 110 for their own convenience. For example, users may put any a small vase, a picture frame, a coffee cup, etc. on the top surface 111 of the image forming apparatus 100. Alternatively, users can put a digital apparatus, such as a laptop computer or a DVD player, on the top surface 111 of the image forming apparatus 100. Users cannot, however, put anything on top surfaces of the cases of the conventional image forming apparatuses 10 and 30.

Moreover, in the image forming apparatus 100 according to aspects of the present invention, because the image forming unit 140 is disposed in such a way that a height of a part 140*a* of the image forming unit through which a printing medium passes through is lower than a height of a contacting part 135*a* of a feeding roller 135, the image forming apparatus 100 may be designed to have a lower height than a height of the conventional image forming apparatuses 10 and 30. Therefore, an image forming apparatus 100 according to aspects of the present invention may have a more compact and slim size than the sizes of the conventional image forming apparatuses 10 and 30.

Also, in an image forming apparatus 100 according to aspects of the present invention, since a printing medium is discharged through a side 113 of a case 110, space above a printing medium supplying unit 120, along with space on a resting area 101, such as a top surface of a desk where the image forming apparatus 100 is set up, can be used as a storing space for receiving discharged printing media. As a result, a separate printing medium supporting plate is not required.

Furthermore, in an image forming apparatus 100 according to aspects of the present invention, since a top surface 111 of a case 110 is a closed surface and formed in a plane, users can freely use a space above the top surface of the case.

Additionally, since an image forming apparatus 100 according to aspects of the present invention is configured to supply special kinds of printing media, such as envelopes, through a back area of a top surface 111 of a case 110 in a downward direction at, users can easily supply special kinds of printing media into the image forming apparatus 100.

Furthermore, in an image forming apparatus 100 according to aspects of the present invention, since a circuit board 191 of a controller 190 is disposed near a front surface 113 of a case 110, an operation display part 193, a power switch 192, and control buttons 195, which enable users to control the image forming apparatus 100, may be directly mounted on the circuit board 191. As a result, additional parts are not required to separately mount the operation display part 193, the power switch 192, and the control buttons 195 on the case 110 and to connect these components to the circuit board 191. Therefore, manufacturing and assembly costs of the image forming apparatus 100 are decreased.

While described in terms of an image forming apparatus, it is understood that the apparatus can further include facsimile, copying, and/or scanning functionality. Additionally, while described in the context of electro photographic image forming apparatuses, it is understood that the invention can be used in other devices.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a case having a top surface, a bottom surface, a front side, and a rear side, the top surface of the case being formed in a plane substantially parallel to the bottom surface of the case;

a printing medium supplying unit disposed at a lower portion of the case to hold and supply printing media, the printing medium supplying unit comprising a pickup roller disposed adjacent to the rear side of the case;

an image forming unit disposed above the printing medium supplying unit within the case to form images on one of the printing media held by the printing medium supplying unit;

a printing medium feeding part within the case having a feeding roller to feed a printing medium from the printing medium supplying unit to the image forming unit and a printing medium feeding path that connects the feeding roller with the image forming unit and which is inclined in a downward direction to feed the printing medium down to the image forming unit;

a fixing unit within the case to fix images formed by the image forming unit onto the printing medium;

an exposure unit disposed above the image forming unit to form an electrostatic latent image on a photosensitive medium of the image forming unit;

a discharging unit to discharge the printing medium with the fixed images outside of the case through the front side of the case; and a printing medium supporting part formed as a single body with the front side of the case and which extends from the front side of the case, the front side of the case being substantially perpendicular to the top surface and the bottom surface of the case, toward the discharging unit, above a portion of the print medium supplying unit such that the printing medium supporting part overlaps the portion of the print medium supplying unit in a vertical direction, and the printing medium supporting part is inclined downward along a printing medium discharging direction so as to support the printing medium on an incline.

2. The image forming apparatus according to claim 1, further comprising:

an auxiliary printing medium supplying unit disposed between the top surface of the case and the feeding roller to supply another printing medium to the image forming unit.

3. The image forming apparatus according to claim 2, wherein the auxiliary printing medium supplying unit comprises a printing medium entrance formed at a back area of the top surface of the case.

4. The image forming apparatus according to claim 3, wherein the auxiliary printing medium supplying unit further comprises a door to selectively open or close the printing medium entrance.

5. The image forming apparatus according to claim 1, wherein the image forming unit is disposed so that a height from the bottom surface of the case to a part of the image forming unit at which images are transferred onto the printing medium is lower than a height from the bottom surface of the case to a top end of the feeding roller.

6. The image forming apparatus according to claim 5, wherein the height from the bottom surface of the case to the top end of the feeding roller is approximately 90 mm or less.

7. The image forming apparatus according to claim 6, wherein the height from the bottom surface of the case to the part of the image forming unit at which images are transferred onto the printing medium is approximately 60 mm.

8. The image forming apparatus according to claim 1, wherein a height from the bottom surface of the case to the top surface of the case is approximately 150 mm or less.

9. The image forming apparatus according to claim 1, wherein the discharging unit is disposed above the printing medium supplying unit at a side of the fixing unit to discharge the printing medium through the front side of the case.

10. The image forming apparatus according to claim 1, wherein the fixing unit is disposed so that a height from the bottom surface of the case to a part of the fixing unit through which the printing medium passes is substantially the same height as a height from the bottom surface of the case to a part of the image forming unit at which images are transferred onto the printing medium.

11. The image forming apparatus according to claim 1, wherein the discharging unit is disposed so that a height from the bottom surface of the case to a part of the discharging unit through which the printing medium passes is higher than a height from the bottom surface of the case to a part of the fixing unit through which the printing medium passes.

12. The image forming apparatus according to claim 1, further comprising a controller disposed above the discharging unit near the front side of the case through which the printing medium is discharged.

13. The image forming apparatus according to claim 1, wherein control buttons are disposed in the top surface of the case.

14. The image forming apparatus according to claim 1, wherein the discharging unit discharges the printing medium through the front side of the case in a same direction as a direction along which the printing medium travels along the printing medium path that connects the feeding roller with the image forming unit.

15. The image forming apparatus according to claim 1, wherein at least a portion of the printing medium supporting part is inclined downward between the front side of the case and the discharging unit.

16. The image forming apparatus according to claim 1, wherein a second printing medium feeding path connects the fixing unit with the discharging unit and is inclined in an upward direction to feed the printing medium up to the discharging unit, and a third printing medium feeding path connects the image forming unit and the fixing unit and is formed in a substantially concave shape.

* * * * *